US008791840B2

(12) United States Patent
McGuffin et al.

(10) Patent No.: US 8,791,840 B2
(45) Date of Patent: Jul. 29, 2014

(54) SYSTEMS AND METHODS FOR AN ACTIVE PROMPT FOR TIMED RESPONSE CONTROLLER PILOT DATA LINK COMMUNICATION (CPDLC) MESSAGES

(75) Inventors: Thomas F. McGuffin, Bellevue, WA (US); Patrick Ludwig, Renton, WA (US)

(73) Assignee: Honeywell International Inc., Morristown, NJ (US)

( * ) Notice: Subject to any disclaimer, the term of this patent is extended or adjusted under 35 U.S.C. 154(b) by 230 days.

(21) Appl. No.: 13/312,083

(22) Filed: Dec. 6, 2011

(65) Prior Publication Data

US 2013/0141254 A1 Jun. 6, 2013

(51) Int. Cl.
*G08B 21/00* (2006.01)

(52) U.S. Cl.
USPC ..... 340/945; 340/971; 701/1; 701/3

(58) Field of Classification Search
CPC ..... G08G 5/0021; G08G 5/0013; G08G 5/00; G08G 5/0017
USPC ..... 340/945, 971; 701/1, 3
See application file for complete search history.

(56) References Cited

U.S. PATENT DOCUMENTS 7,495,602 B2 2/2009 Sandell et al.
2008/0163093 A1 7/2008 Lorido
2010/0277347 A1* 11/2010 Judd ..... 340/945

OTHER PUBLICATIONS

LINK2000+, "Flight Crew Data Link Operational Guidance for LINK2000+ Services", "LINK2000+ Programme", Jun. 30, 2009, pp. i-66, Publisher: Eurocontrol.
Mackintosh et al., "Designing Procedures for Controller-Pilot Data Link Communication: Effects of Textual Data Link on Information Transfer", "1999 World Aviation Conference", Oct. 19-21, 1999, pp. i-8, Publisher: SAE International & American Institute of Aeronautics and As.

* cited by examiner

*Primary Examiner* — Brian Zimmerman
*Assistant Examiner* — Sara Samson
(74) *Attorney, Agent, or Firm* — Fogg & Powers LLC

(57) ABSTRACT

Systems and methods for providing an active prompt for a timed response are provided. In one embodiment, a system comprises a human machine interface that presents controller pilot data link communication (CPDLC) information to a user, and a CPDLC computer configured to process received CPDLC messages. In certain embodiments, the CPDLC computer comprises a memory device that stores received CPDLC messages, and a processing unit that starts a timer when a CPDLC message is received, wherein the timer counts a response period for responding to the CPDLC message. Further the processing unit instructs the human machine interface to display a time remaining in the response period when the timer reaches a message expiration warning period.

17 Claims, 7 Drawing Sheets

SYSTEMS AND METHODS FOR AN ACTIVE PROMPT FOR TIMED RESPONSE CONTROLLER PILOT DATA LINK COMMUNICATION (CPDLC) MESSAGES

BACKGROUND

Certain applications in avionics datalink systems allocate finite amounts of time for responding to received messages. Controller Pilot Data Link Communication (CPDLC) systems include such applications. When a pilot receives a CPDLC message, the CPDLC system gives the pilot a set period of time to respond to the message. For example, in some systems after receiving a message, the system gives a pilot 100 seconds to send a response to the message. If the provided period of time lapses before the pilot responds to the received message, the pilot loses the ability to respond to the message.

For the reasons stated above and for other reasons stated below which will become apparent to those skilled in the art upon reading and understanding the specification, there is a need in the art for improved systems and methods for an active prompt to timed response CPDLC messages.

SUMMARY

The embodiments of the present invention provide methods and systems for an active prompt to a timed response and will be understood by reading and studying the following specification.

Systems and methods for providing an active prompt for a timed response are provided. In one embodiment, a system comprises a human machine interface that presents controller pilot data link communication (CPDLC) information to a user, and a CPDLC computer configured to process received CPDLC messages. In certain embodiments, the CPDLC computer comprises a memory device that stores received CPDLC messages, and a processing unit that starts a timer when a CPDLC message is received, wherein the timer counts a response period for responding to the CPDLC message. Further the processing unit instructs the human machine interface to display a time remaining in the response period when the timer reaches a message expiration warning period.

DRAWINGS

Embodiments of the present invention can be more easily understood and further advantages and uses thereof more readily apparent, when considered in view of the description of the preferred embodiments and the following figures in which.

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Embodiments of the present invention address the need of avoiding stale CDPLC messages due to the expiration of the time provided for responding to the messages. In one embodiment, a CPDLC system displays an active prompt to a user to indicate when a received message is about to become stale. The system monitors the response period for each received message. When for a particular message the time remaining to respond is less than a predetermined period of time, a warning is provided to a user indicating the amount of time they have remaining to respond to the message. Thus, the system apprises a user of the time remaining before the message expires so the user can act to prevent the received message from going stale.

Figure 1:
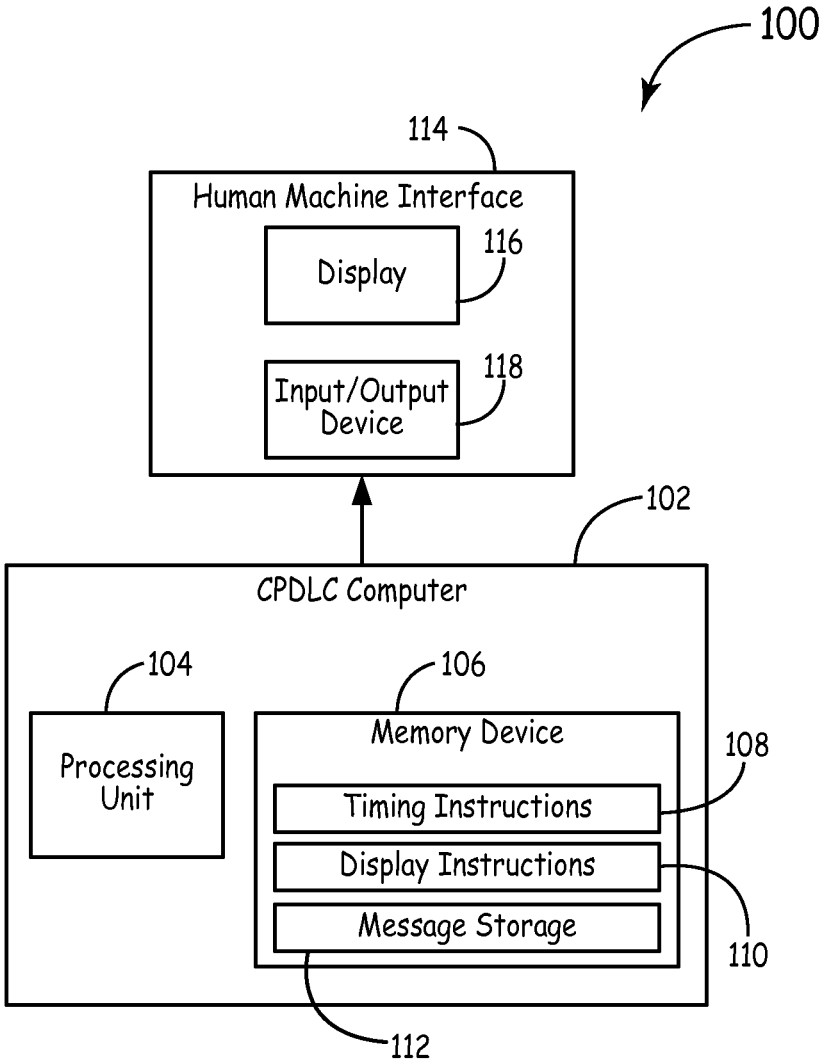
FIG. 1 is a block diagram of a CPDLC system of one embodiment of the present invention.

FIG. 1 is a block diagram of a CPDLC system 100 of one embodiment of the present invention. System 100 includes a CPDLC computer 102 that processes and communicates CPDLC messages via a CPDLC link. In alternate implementations, CPDLC computer 102 is located either on the ground or in aircraft. For example, in one implementation, an air traffic controller uses CPDLC computer 102 to communicate with pilots. Likewise, in another implementation, a pilot uses CPDLC computer 102 to communicate with air traffic controllers. In a further implementation, CPDLC computer 102 handles specific formats of CPDLC communication. For example, CPDLC computer 102 functions as a flight management computer (FMC) and handles communication streams using ATN CPDLC. Alternatively, CPDLC computer 102 functions as a communications management unit (CMU) and handles communication streams using ATN CPDLC. In some implementations, CPDLC computer 102 functions as an integrated FMC/CMU, a communications management function, a flight management function, an electronic flight bag, and the like.

When handling received messages, CPDLC computer 102 provides only a limited time period in which a user can respond to received messages. For example, when the user is a pilot and CPDLC computer 102 receives a message from an air traffic controller, CPDLC computer 102 provides a time period of 100 seconds in which the pilot is able to respond to the received message. The time period for responding to received messages is referred to herein as the "response period". If the pilot fails to respond to the message within the response period, the message becomes stale and the CPDLC computer 102 will prevent the pilot from responding to the message. In a similar example, when the user is an air traffic controller and CPDLC computer 102 receives a message from a pilot, CPDLC computer 102 provides a response period of 240 seconds in which an air traffic controller is able to respond to the received message. To avoid the inconveniences created by stale messages, CPDLC computer 102 monitors the time remaining in the response period. When the time remaining is within a message expiration warning period, CPDLC computer 102 interacts with a human machine interface 114 to display the time remaining in the response period to the user.

Figure 2:
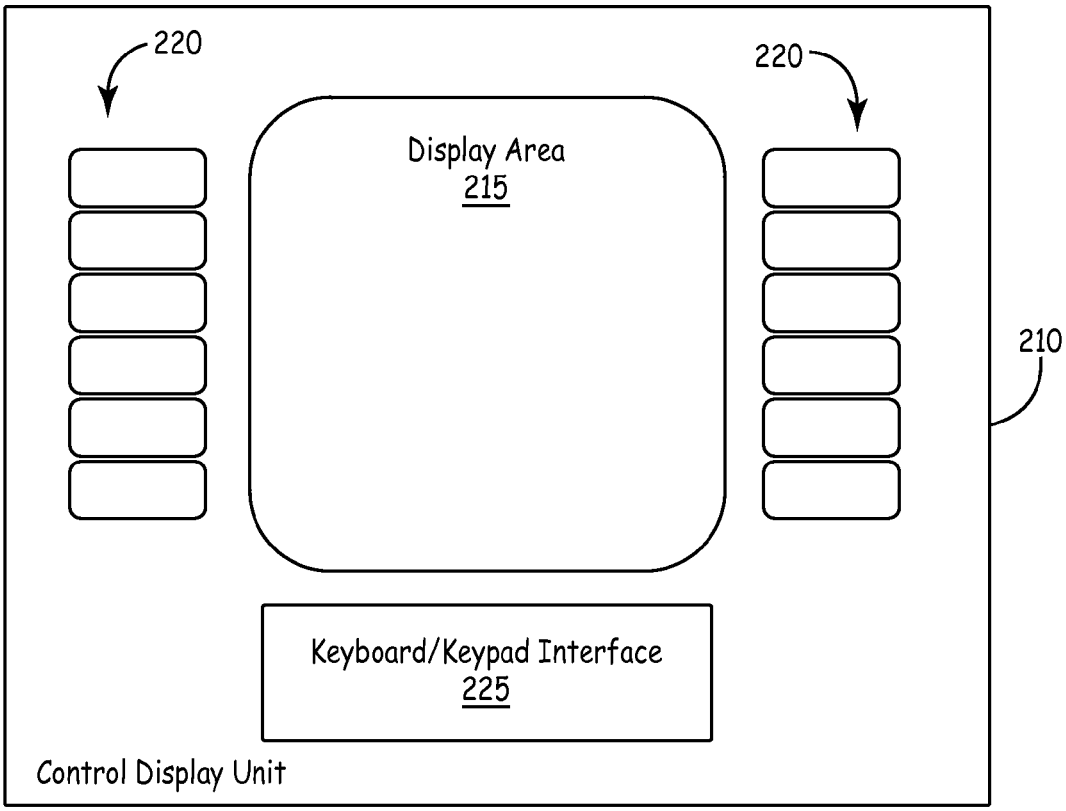
FIG. 2 is a block diagram of a control display unit (CDU) for a human Machine interface of one embodiment of the present invention.

Human machine interface 114 includes a display 116 that displays screens generated by CPDLC computer 102 and an input/output device 118 to allow a user, like a pilot, to enter data and select responses. In some embodiments, a user, like a flight crew member, using display 116, is able to select user-selectable fields on a screen using a cursor controlled interface, such as a multifunction display. In another embodiment, the user controls the screens on display 116 using a multipurpose control display unit, such as shown in FIG. 2. FIG. 2 illustrates a control display unit 210 for controlling human machine interface 114 that includes a display area 215, a plurality of programmable buttons 220 on either side of the display area 215, and a keyboard interface 225. In yet other embodiments, the display 116 provides aspects of both a multifunction display and a multipurpose control display unit to interface with the user.

CPDLC computer 102 includes a processing unit 104 that is directed by computer instructions to control the content that is displayed on human machine interface 114. CPDLC computer 102 also includes a memory device 106 to store data and instructions for directing the execution of processing unit 104. For example, memory device 106 includes timing instructions 108 and display instructions 110. Memory device 106 also includes message storage 112 for storing messages received by CPDLC computer 102. When CPDLC computer 102 receives a message, timing instructions 108 direct processing unit 104 to associate a timer with the message. In one implementation, the processing unit 104 initially sets the timer to zero and increments the timer until the timer reaches a value that indicates that the timer has expired. Alternatively, the processing unit 104 initially sets the timer to a specific time value and decrements the timer until the timer reaches zero. Processing unit 104, executing display instructions 110, controls the displayable information sent to human machine interface 114. Human machine interface 114 receives the displayable information and renders it on a display 116 for a user to view.

In operation, when the time remaining in the response period becomes less than a sentinel time value, a pre-message expiration warning is displayed indicating the time remaining in the response period. For example, when a message is received, timing instructions 108 direct processing unit 104 to start a timer that counts a period of time based on the allowed response period for the message. After a predetermined portion of the response period elapses, but prior to the response period elapsing, a message expiration warning period begins. When the time remaining in the response period is within the message expiration warning period then the display instructions 110 instruct processing unit 104 to send timing information associated with the message to human machine interface 114. Human machine interface 114 renders the received timing information as a representation of the time remaining before the response period for a particular message expires.

For example, in one implementation, where the message expiration warning period is thirty seconds, CPDLC computer 102 receives a message, whereupon timing instructions 108 instruct processing unit 104 to associate a timer with the message and begin counting the time for the response period. While the timer is counting, display instructions 110 instruct processing unit 104 to monitor the timer. When the timer has only the message expiration warning period remaining, display instructions 110 instruct processing unit 104 to send displayable information associated with the timer to human machine interface 114. Human machine interface 114 then renders the displayable information on display 116 as a representation of the time left in the response period before the message expires.

Figure 3:
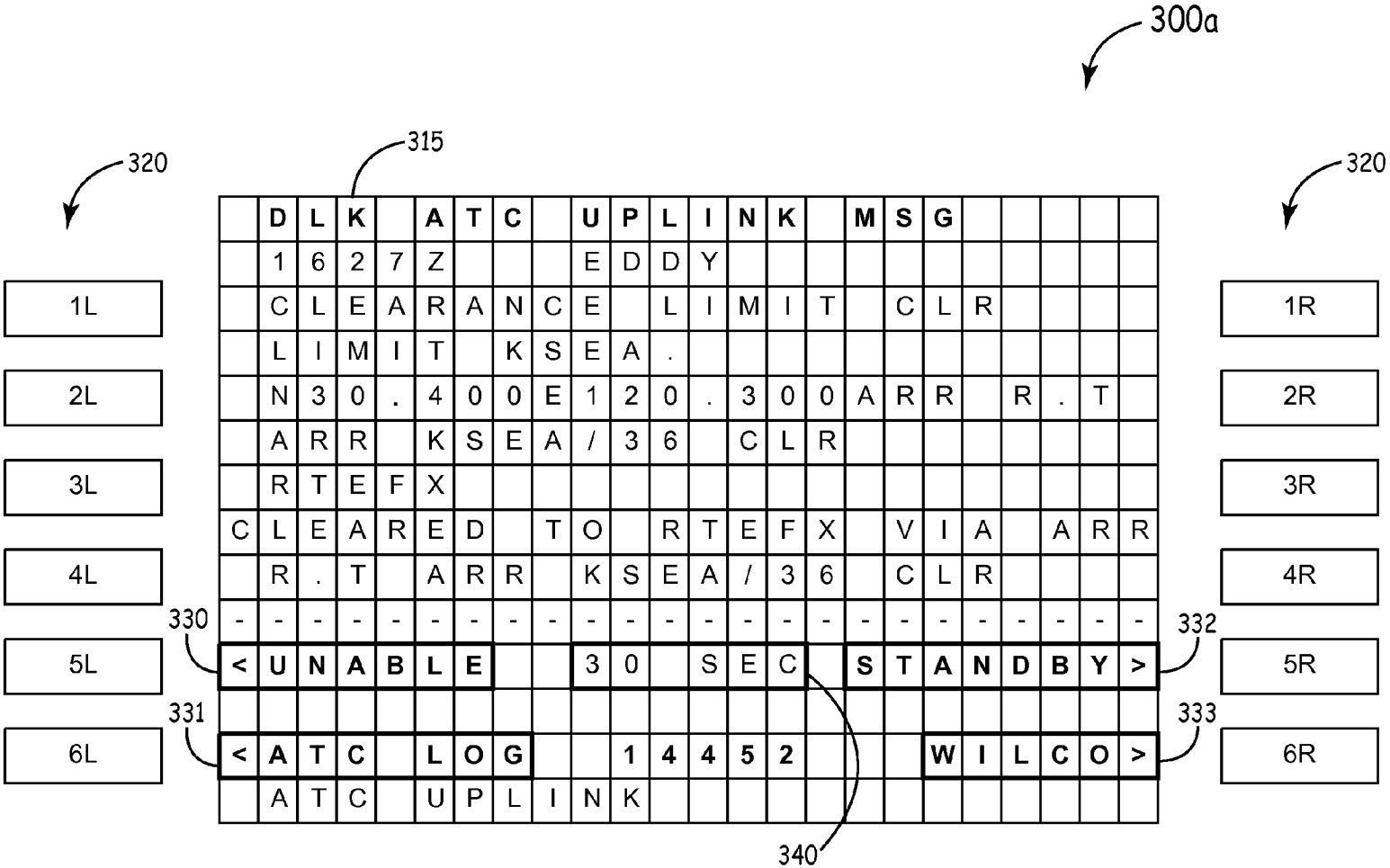
FIG. 3 is a block diagram of a message screen of one embodiment of the present invention.

In one embodiment, display instructions 110 direct processing unit 104 to instruct human machine interface 114 to display the timer information on a message screen. A message screen is a screen provided on display 116 where a user can access the contents of the received message. FIG. 3 is an illustration representing a view 300 of human machine interface 114 when display 116 displays a message screen 315. In certain embodiments, message screen 315 includes selectable fields 330, 331, 332, and 333. A user can select user selectable fields 330, 331, 332, and 333 through input/output device 118, illustrated in view 300 as programmable buttons 320. For example, a user can select user selectable field 330 by pressing programmable button 5L or the user can select user selectable field 333 by pressing programmable button 6R. Further, message screen 315 includes a timer field 340 to indicate to a user the time left in the response period when the timer is within the message expiration warning period. When the CPDLC computer 102 determines that the time remaining in the response period is within the message expiration warning period, CPDLC computer will send displayable information to human machine interface 114 to display timer field 340. Thus, when a user is viewing message screen 315 and the timer enters the message expiration warning period, timer field 340 will appear on message screen 315. The appearance of the timer field 340 on message screen 315 notifies the user that the message is about to go stale.

To respond before a message expires, in some implementations, CPDLC computer 120 in FIG. 1 provides preprogrammed responses to messages. As shown in message screen 315 in FIG. 3, an air traffic controller has sent a message to a pilot, the pilot has two options to select that will respond to the received message. For example, to respond by indicating that the pilot is unable to comply with instructions in the message, a pilot or flight crew member selects the programmable button 320 associated with selectable field 330, shown as 5L. Conversely, the pilot or other flight crew member can indicate to the air traffic controller an intent to comply with the message instructions by selecting programmable button 320 associated with selectable field 333, shown as 6R.

In some implementations, a pilot may not have enough time to respond, may forget to respond, or choose not to immediately respond to the message before the time shown in timer field 340 expires. To avoid the expiration of the received message, the pilot or flight crew selects programmable button 320 associated with selectable field 332, shown as 5R, which sends a standby command to CPDLC computer 102. When CPDLC computer 102 receives a standby command, CPDLC computer 102 re-initiates the timer associated with the response period. When the timer is re-initiated, the timer field 340 disappears until the re-initiated timer reenters the message expiration warning period. In addition, in some implementations, the standby option is selectable for a limited number of times. For example, the standby option is selectable once by a user. Thus, once a user chooses the standby selectable field 333, the option to choose selectable field 333 disappears.

Figure 4:
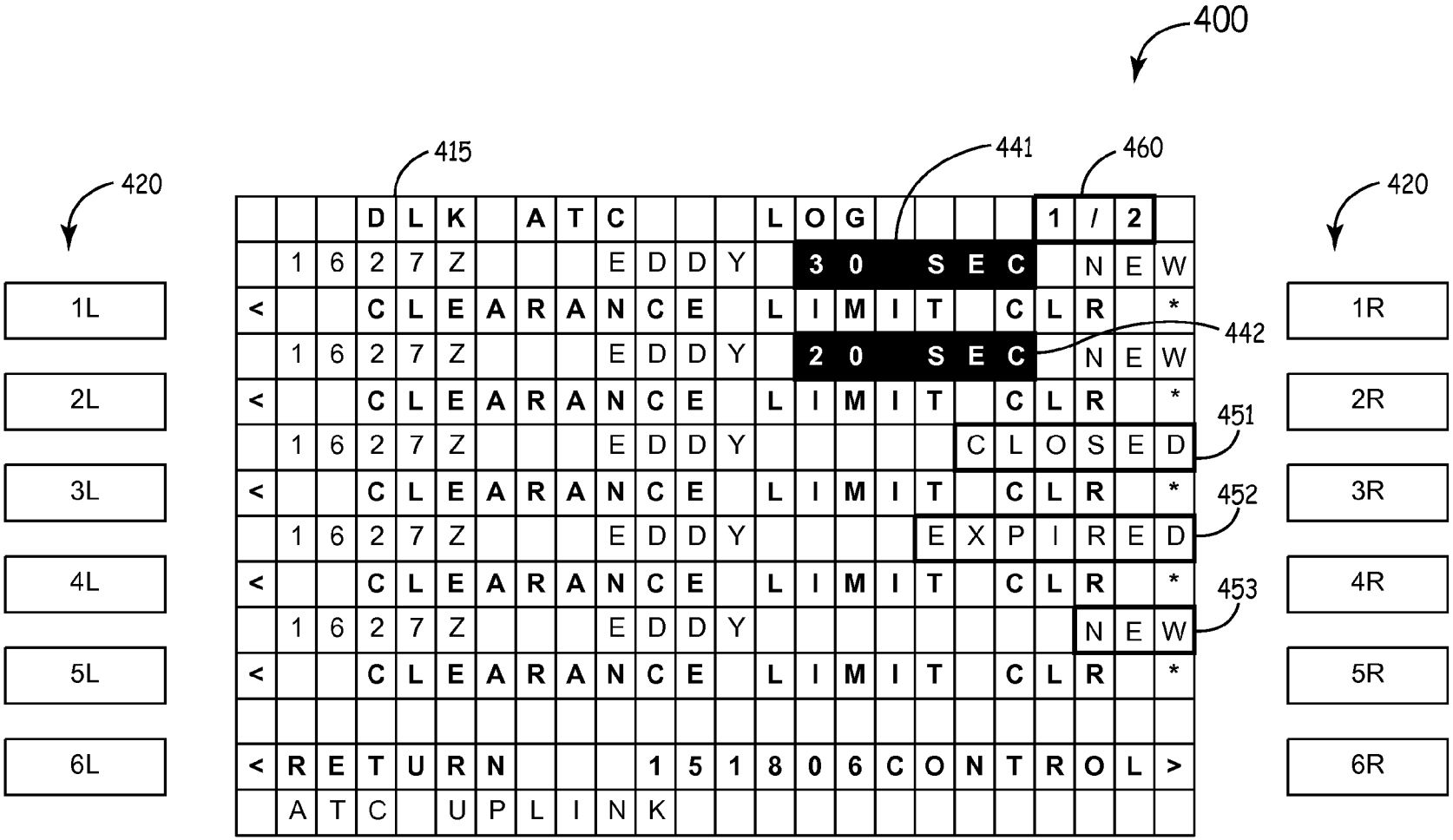
FIG. 4 illustrates a display screen of one embodiment of the present invention.

In certain embodiments, a user can view a message log on display 116 by selecting a programmable button 320 associated with selectable field 331, such as shown as 6L. A message log is a series of screens showing the messages that CPLDC computer 102 has received. FIG. 4 is an illustration representing a view 400 of human machine interface 114 when display 116 displays a message log screen 415. Message log screen 415 shows information associated with multiple received messages that are stored in message storage 112 in FIG. 1. A user can select to view the messages displayed in the message log by selecting the programmable buttons 420. Further, display instructions 110 instruct processing unit 104 to display multiple screens such that a user can page through the multiple screens to view and select messages stored on message storage 112. For example, in some implementations, the message log can include enough screens to allow a user to select up to 100 received messages. For example, view 415 shows a page numbering 460 to indicate both the current page number of the message log and the total number of pages of messages that a user can select in the message log.

In certain embodiments, the status of messages is displayed in status fields 451, 452, and 453 as displayed in message log screen 415. In some implementations, the status of a message can be new, closed, or expired. A new message, as illustrated by status field 453, is an active message that is awaiting a reply from the recipient. A closed message, as illustrated by status field 451, is an old message to which the recipient has already responded. An expired message, as illustrated by status field 452, is an old message to which the recipient failed to respond within the required period of time.

To aid a user in preventing messages from expiring due to the expiration of a timer associated with a message, display instructions 110 direct processing unit 104 to display the respective time left for responding for each new message in the message log. For example, when the timer for a message reaches the message expiration warning period, the time remaining in the response period for the message is displayed adjacent to where the message is listed in the message log. For example, in message log screen 415, there are three new messages. Two of the messages have the associated time remaining for a response displayed next to the message in timer fields. In particular, one message has thirty seconds before the message expires, as shown in timer field 441, and the other message has twenty seconds before the message expires, as shown in timer field 442. Further, the message associated with status field 453 does not have a time remaining displayed because the timer associated with that message has not yet reached the message expiration warning period for the timer. Additionally, to further alert the user that a response period is about to expire, the appearance of timer fields 442 and 441 is altered to differentiate it from the surrounding display. For example, display 116 displays the timer fields 441 and 442 using a reverse color field, blinking, and the like.

Figure 5:
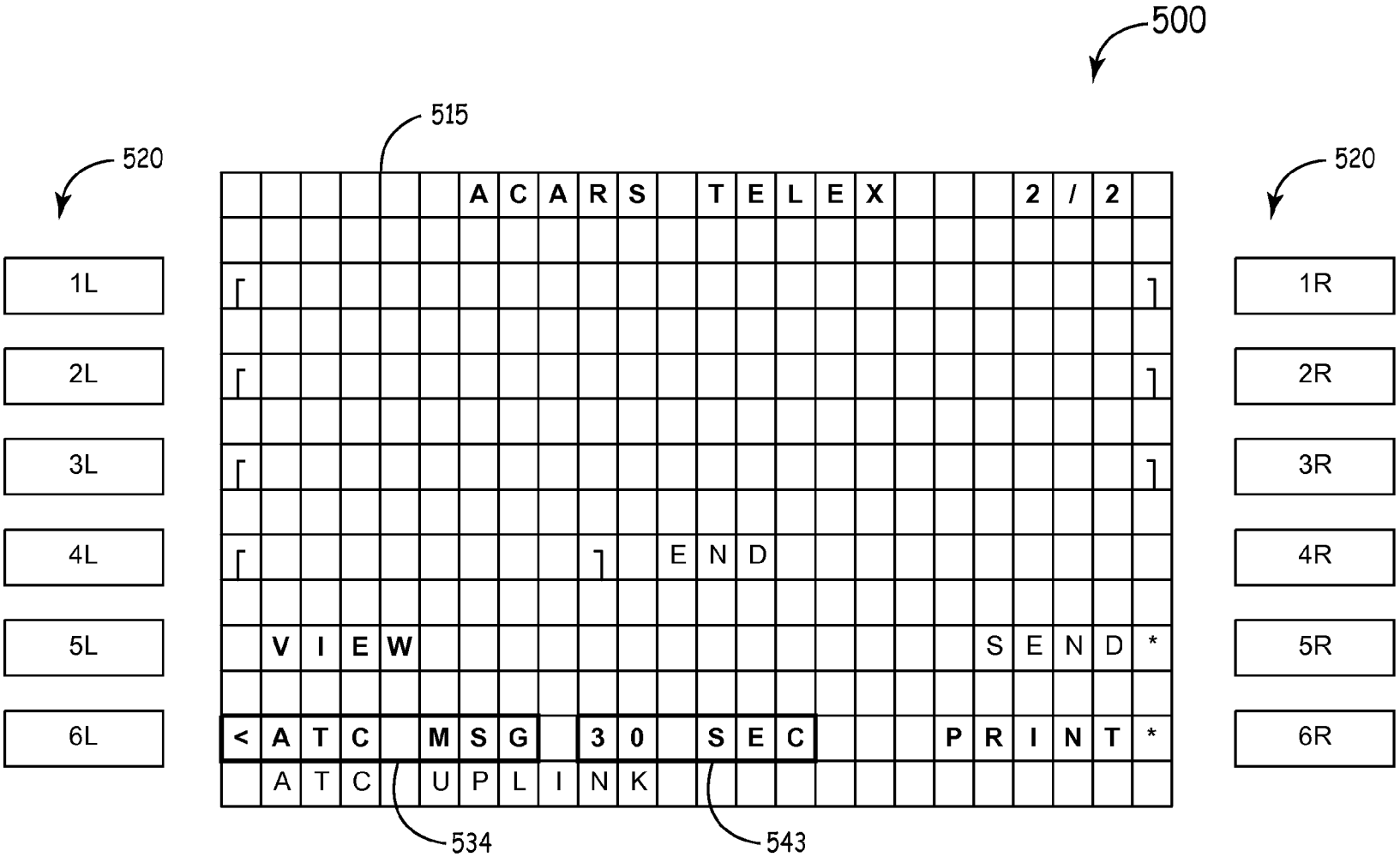
FIG. 5 illustrates a display of one embodiment of the present invention.

In certain embodiments, to more fully enable a user to respond to a message, shortcuts to messages are displayed on screens other than message screens and message log screens. This category of screen is referred to herein as non-message screens. In other words, the term "non-message screen" is a screen that a user uses for a purpose that is not related to receiving or responding to a message. FIG. 5 illustrates a view 500 of human machine interface 114 when display 116 displays a non-message screen 515 that includes a shortcut to a message screen for a particular message. When display 116 shows a message shortcut, human machine interface 114 displays a selectable field 534 that a user can select by pressing an associated programmable button 520, shown as 6L. When a user presses the associated programmable button 520, human machine interface 114 will display the message associated with the shortcut. If CPDLC Computer 102 has received multiple messages, the display instructions 110 will direct processing unit 104 to display a shortcut to the message that has the smallest amount of time left in the response period. In an alternative embodiment, the human machine interface displays a shortcut to the message log instead of a particular message screen.

In further embodiments, the message shortcut selectable field 534 is accompanied by an associated timer field 543. Display instructions 110 instruct processing unit 104 to provide timing information to the human machine interface 114 and display the timing information accompanying the message shortcut. For example in non-message screen 515, timer 543 is displayed next to selectable field 534 to indicate to a user the time left in the response period for the message associated with the message shortcut. Further, the human machine interface 114 displays the timer in a reverse colored field or with blinking numbers.

In certain embodiments, where the timer field 543 is displayed next to a short cut selectable field 534 on a non-message screen 515, upon the expiration of the timer, the display instructions 110 direct processing unit 104 to check message storage 112 for other messages that are awaiting responses. If there are no messages awaiting a response in message storage 112, then display instructions 110 directs processing unit 104 to remove the timer field 543 and shortcut selectable field 534 from non-message screen 515. In contrast, if there are messages awaiting a response in message storage 112, display instructions 110 instruct processing unit 102 to associate the message shortcut displayed on display 116 with the next message that is closest to expiring. If the timer associated with the next message is within the timer threshold, then non-message screen 515 will include a timer field 543 indicating the time remaining before the next message expires. If the timer has not reached the timer threshold, then non-message screen 515 will not include a timer field 543. By displaying the timer field and associated message shortcut on non-message screens, the user is made aware that messages between pilots and air traffic controllers are about to expire.

Figure 6:
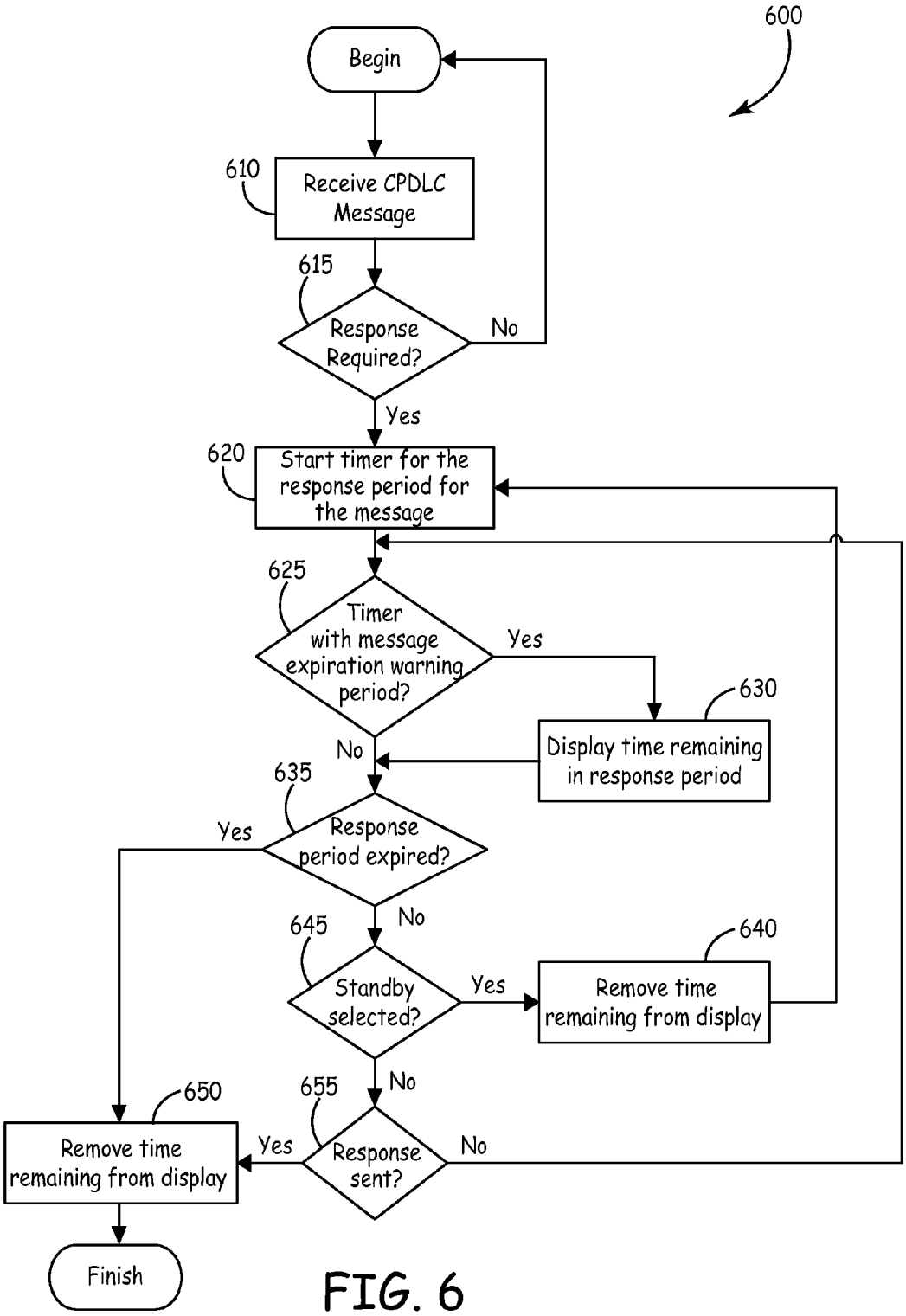
FIG. 6 is a flow chart illustrating a method of one embodiment of the present invention.

FIG. 6 is a flow chart illustrating one embodiment of a method 600 for providing an active prompt to a timed response. Method 600 begins at 610 where a CPDLC system receives a CPDLC message. In one embodiment, method 600 is performed by the CPDLC system 100 described if FIG. 1. As such, options and alternative embodiments described with respect to FIG. 1 apply to method 600 and vice versa. When the CPDLC system receives a message, the CPDLC system determines whether a response is required (shown at 615). For the situation where the received CPDLC message does not require a response from the recipient, the method 600 simply returns to 610. When the CPDLC message does require a response, method 600 proceeds to 620 where the CPDLC system starts a timer that counts a response period for the message.

While the timer is counting, the method proceeds to 625 and checks whether the timer is within a message expiration warning period. When the timer is within the message expiration warning period, method 600 proceeds to 630 with displaying the time remaining in the response period. Otherwise, when the timer is not within the message expiration warning period, method 600 does not display the time remaining Further, the CPDLC system monitors the timer to determine if the response period is expired (shown at 635). As long as the response period is not expired, the method proceeds to 645 and checks to see whether a user has selected a standby command. When the user has selected the standby command, method 600 returns to 620, restarts the timer for the response period for the message, and clears the display of the time remaining in the response period. When standby is not selected, the method proceeds to 655 to see whether a response was sent to the received message. If not, method 600 returns to 625. When either a response has been sent (checked at 655), or the response period has expired (checked at 635), then method 600 proceeds to 650 by clearing the time remaining from the display. As would be appreciated by one of ordinary skill in the art upon reading this specification, the CPDLC system will very often be processing multiple received CPDLC messages at any one time. Accordingly, in one embodiment, a CPDLC system (such as system 100) will be executing multiple simultaneous instances of method 600. For example, in one embodiment, the CPDLC system will have multiple instances of method 600 executing at the same time, one instance for each received CPDLC message that needs to be processed.

Figure 7:
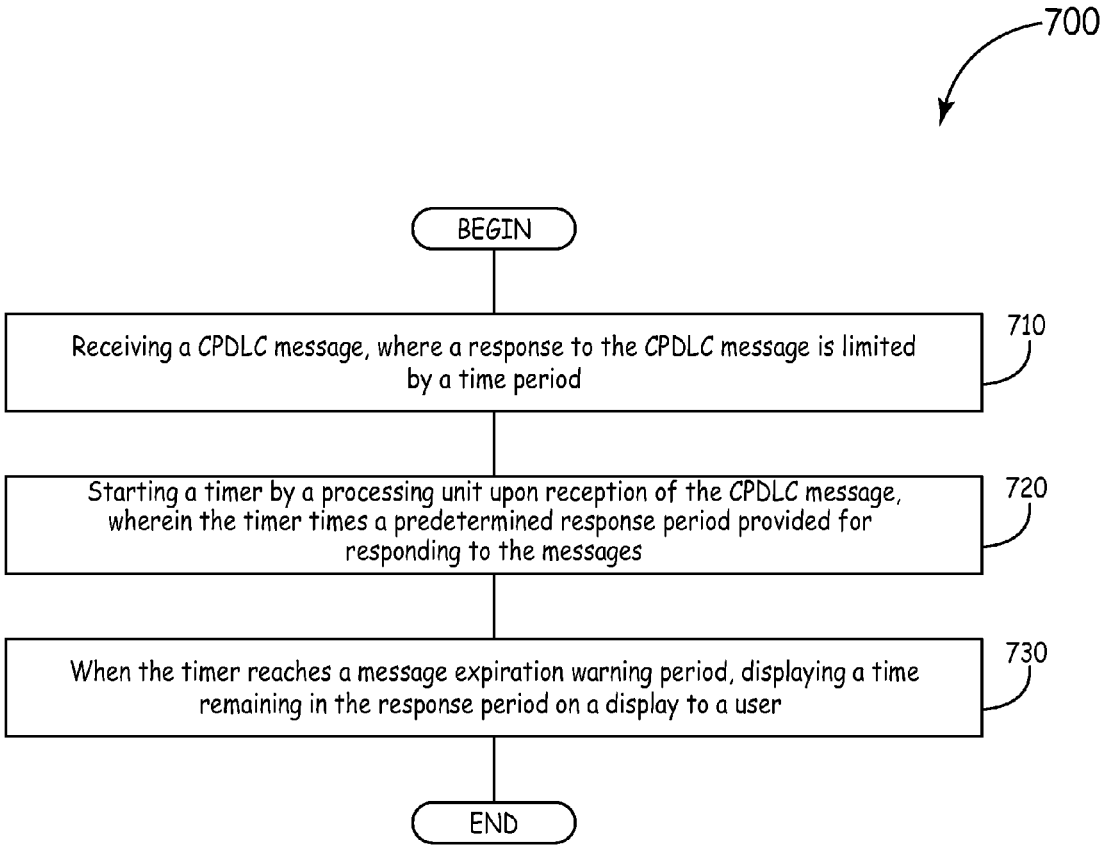
FIG. 7 is a flow chart illustrating a method of one embodiment of the present invention.

FIG. 7 illustrates a method 700 for providing an active prompt to a timed response for one embodiment of the present invention. In one embodiment, method 700 is performed by the CPDLC system 100 described if FIG. 1, and in at least one implementation, is performed using components described above with respect to FIGS. 1 and 2. As such the teachings and alternate embodiments and implementations described for any of the embodiments described above can be combined with those of the method of FIG. 7 and vice versa.

The method begins at 710 with receiving a CPDLC message. A CPDLC computer receives the message which has a limited time period in which a user can respond to the message. For example, in some implementations, when the CPDLC computer receives messages from an air traffic controller, the pilot has 100 seconds to respond to the message. Alternatively, when the CPDLC computer receives messages from a pilot, the air traffic controller has 240 seconds to respond to the message.

The method proceeds to 720 with starting a timer upon reception of the CPDLC message, wherein the timer times a predetermined response period provided for responding to the message. When a CPDLC message is received, the CPDLC computer starts a timer to enforce the limited response time for the user. Should the timer expire, the message will become stale and a user will be unable to respond to the message.

When the timer reaches a message expiration warning period, the method proceeds to 730 with displaying a time remaining in the response period on a display to a user. In one embodiment, the CPDLC computer monitors the timer until it reaches a threshold value. When the timer reaches the threshold value, the CPDLC computer directs a human machine interface to display the time remaining before message expiration. By displaying the time remaining in the response period only during the message expiration warning period, the pilot is not distracted by running timers on messages still having ample time for response. Instead, the timer is displayed only when the time remaining in the response period is sufficiently short that the pilot should be made aware of an impending message expiration.

Several means of hardware are available to implement the systems and methods of the current invention as discussed in this specification. These means of hardware include, but are not limited to, digital computer systems, microprocessors, general purpose computers, programmable controllers and field programmable gate arrays. Therefore other embodiments of the present invention are program instructions resident on computer readable storage media which when implemented by such devices, enable them to implement embodiments of the present invention. Computer readable media include any form of physical computer data storage hardware, including but not limited to punch cards, magnetic disk or tape, any optical data storage system, flash read only memory (ROM), non-volatile ROM, programmable ROM (PROM), erasable-programmable ROM (E-PROM), random access memory (RAM), or any other form of permanent, semi-permanent, or temporary memory storage system or device. Program instructions and code include, but are not limited to computer-executable instructions executed by computer system processors and hardware description languages such as Very High Speed Integrated Circuit (VHSIC) Hardware Description Language (VHDL).

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended to cover any adaptations or variations of the present invention. Therefore, it is manifestly intended that this invention be limited only by the claims and the equivalents thereof.

What is claimed is:

1. A method for an active prompt for a timed response, the method comprising:

receiving a CPDLC message, where a response to the CPDLC message is limited by a response period;

starting a timer upon reception of the CPDLC message, wherein the timer times the response period provided for responding to the CPDLC message;

when the timer reaches a message expiration warning period, displaying a time remaining in the response period on a display to a user;

displaying a shortcut to access the message on a non-message screen; and displaying the time remaining in the response period next to the shortcut.

2. The method of claim 1, further comprising:

receiving a second CPDLC message, where the second CPDLC message is associated with a second response period; and starting a second timer upon reception of the second CPDLC message.

3. The method of claim 2, further comprising displaying a message log showing the CPDLC message and the second CPDLC message, wherein the message log displays a time remaining in the response period for the CPDLC message when the timer for the CPDLC message is within the message expiration warning period; and and the message log displays a second time remaining in the second response period for the second CPDLC message when the second timer is within the message expiration warning period.

4. The method of claim 1, wherein the processing unit is on at least one of a communications management unit and a flight management computer.

5. The method of claim 1, further comprising removing the displayed time remaining upon at least one of:

a standby command is received;

the response to the CPDLC message is transmitted; and the timer expires.

6. The method of claim 1, wherein the time remaining in the response period displayed next to the shortcut represents the time remaining for a message in a plurality of messages that is closest to expiring.

7. The method of claim 1, further comprising removing the shortcut from non-message screens on the display when the response period for the message expires and there are no further messages awaiting a response.

8. The method of claim 1, wherein the shortcut to access the message is a shortcut to at least one of:

the message; and a message log.

9. The method of claim 1, wherein the message expiration warning period is thirty seconds in duration.

10. A system for providing an active prompt for a timed response, the system comprising:

a human machine interface that presents controller pilot data link communication (CPDLC) information to a user; and a CPDLC computer configured to process received CPDLC messages, the CPDLC computer comprising:

a memory device that stores received CPDLC messages; and a processing unit that starts a timer when a CPDLC message is received, wherein the timer counts a response period for responding to the CPDLC message;

wherein the processing unit instructs the human machine interface to display a time remaining in the response period when the timer reaches a message expiration warning period; and wherein the processing unit instructs the human machine interface to display a shortcut to access the CPDLC message on a non message screen and display the time remaining next to the shortcut when the timer is within the message expiration warning period.

11. The system of claim 10, wherein the CPDLC computer functions as at least one of:

a communications management unit; and a flight management computer.

12. The system of claim 10, wherein the processing unit is further configured to remove the time remaining in the response period from being displayed by the human machine interface upon a reception of a standby command from the user.

13. The system of claim 10, wherein, when the processing unit has received a plurality of messages, the time remaining displayed next to the shortcut on non message screens represents the time remaining in the response period for a message in the plurality of messages that is closest to expiring.

14. The system of claim 10, wherein the processing unit is further configured to remove the shortcut from the non-message screens when the response period for the message expires and there are no further messages to display.

15. The system of claim 10, wherein the shortcut to access the message directs a user to at least one of:

a message log; and the message.

16. The system of claim 10, wherein the processing unit directs human machine interface to display the timer using at least one of:

blinking text; and reverse color fields.

17. A non-transitory computer readable data storage device having computer executable code to perform a method for providing an active prompt for a timed response, the method comprising:

receiving a CPDLC message, where a response to the CPDLC message is limited by a response period;

starting a timer upon reception of the CPDLC message, wherein the timer times the response period provided for responding to the messages;

when the timer reaches a message expiration warning period, displaying a time remaining in the response period on a display to a user, and displaying a shortcut to access the message on a non-message screen; and displaying the time remaining in the response period next to the shortcut.

* * * * *